US005114072A

United States Patent [19]

Barhydt, Sr.

[11] Patent Number: 5,114,072

[45] Date of Patent: May 19, 1992

[54] WATER AERATOR

[75] Inventor: Dirck Barhydt, Sr., Middlebury, Conn.

[73] Assignee: WPM, Inc., Waterbury, Conn.

[21] Appl. No.: 770,370

[22] Filed: Oct. 3, 1991

[51] Int. Cl.[5] ..... E03C 1/08

[52] U.S. Cl. ..... 239/428.5; 239/533.1

[58] Field of Search ..... 239/428.5, 570, 533.1, 239/590, 590.5, 469; 261/DIG. 22

[56] References Cited

U.S. PATENT DOCUMENTS

| | | | |
|---|---|---|---|
| 3,322,352 | 5/1967 | Alcantara | 239/428.5 |
| 3,664,589 | 5/1972 | Jatho et al. | 239/428.5 |
| 3,684,191 | 8/1972 | Shames et al. | 239/428.5 |
| 4,221,335 | 9/1980 | Shames et al. | 239/428.5 |
| 4,364,523 | 12/1982 | Parkison et al. | 239/590.5 |
| 4,470,546 | 9/1984 | Wildfang | 239/428.5 |
| 4,562,960 | 1/1986 | Marty et al. | 239/570 |
| 5,071,071 | 12/1991 | Chao | 239/428.5 |

*Primary Examiner*—Andres Kashnikow
*Assistant Examiner*—Christopher G. Trainor
*Attorney, Agent, or Firm*—Dallett Hoopes

[57] ABSTRACT

Within a cylindrical barrel to be secured to the water faucet are a basket surrounding a mixing chamber, a diffuser overlying the mixing chamber and forming a diffusing chamber having peripheral openings for flow of water to the mixing chamber, and a pressure-compensating flow controller plug having a control opening for admitting water from said faucet to the diffusing chamber. The flow controller plug has a reduced lower section defining a head and the diffuser has an upward annular flange defining a socket. When the head and socket are engaged, the plug and diffuser are held together as an assembly. The margin of the upper section of the plug forms a seal between the barrel and faucet.

2 Claims, 2 Drawing Sheets

WATER AERATOR

BACKGROUND OF THE INVENTION

1. Field of the Invention

This invention relates to liquid aerators and more particularly to a water aerator adapted to be secured to a faucet. Still more specifically, this invention relates to such an aerator having automatic means for controlling the rate of flow of water therethrough so as to compensate for variations in upstream pressure.

In aerators of the type involved here, water under pressure from the faucet enters a diffuser mounted in a cylindrical casing or barrel releasably secured to the faucet. The diffuser breaks up the flow into fine jets which are directed downward into a chamber where they are mixed with air, an aerated bubbly stream being finally discharged through screens located in the discharge end of the barrel and supported by a basket surrounding the mixing chamber. The action of the water jets maintains a subatmospheric pressure in the mixing chamber, thereby drawing air into this chamber by way of a passage defined by the basket and the surrounding barrel.

2. Description of Related Art including Information Disclosed under §§1.97 to 1.99

It has been proposed heretofore to limit the flow rate into the aerator by means of a flow-restricting disc having a control opening through which the water from the faucet must pass to enter the diffuser. Such a disc has taken the form of a metal plate which snaps into the top of the diffuser as disclosed in U.S. Pat. No. 4,345,719 which issued to my assignee.

A further development has been a pressure-compensating flow controller. This has comprised a circular disc of rubber having a control opening to pass the water flow, the margin of the opening having an upward hub. Under increased upstream pressure, the upward hub is urged radially inward on all sides so that it contracts, and closes down the opening in the plug to reduce flow.

In such developments, the disc has ridden on top of the diffuser and a sealing washer has been required to assure that water does not leak out to the periphery of the diffuser and even through the threads of the barrel where it is secured to the faucet. Further, such aerators, including the separate pressure-compensating flow controllers, suffer from an inability to allow the disc to be assembled into the aerator readily and even automatically, and at the same time, to retain the disc against accidental displacement while allowing easy removal of the disc in cases where a full flow rate is desired.

SUMMARY OF THE INVENTION

The principal object of the present invention is to provide a water aerator which overcomes the above-noted disadvantages.

In an aerator made according to the invention, the diffuser forms a diffusing chamber having peripheral openings for flow of water outwardly and downwardly into the mixing chamber, and the diffuser has an upward annular flange about its upper end. A flow controller plug has a reduced lower section which permits it to function as a plug, fitting frictionally into the annular flange. The diffuser has means for releasably retaining the plug. Preferably, the retaining means consist of resilient inward detents located on the upward annular flange to engage the periphery of the plug.

BRIEF DESCRIPTION OF THE DRAWINGS

For a better understanding of the invention, reference may be had to the following description in conjunction with the accompanying drawings in which.

DESCRIPTION OF THE PREFERRED EMBODIMENTS

Figure 1:
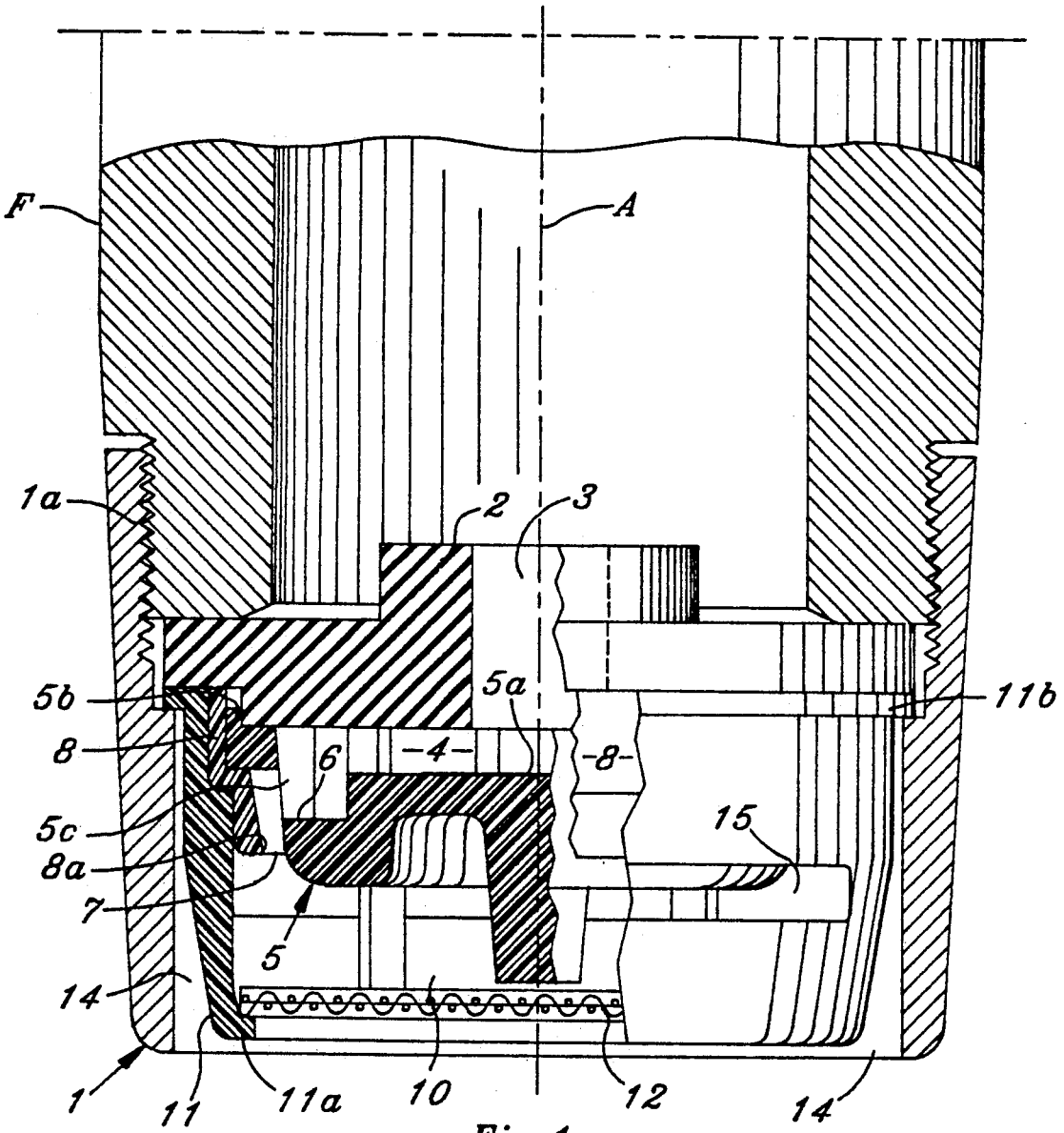
FIG. 1 is a vertical sectional view of the preferred form of the invention.

The illustrated form of the new aerator comprises a cylindrical barrel 1 which is internally threaded at its upstream end, as shown at 1*a*, whereby the barrel can be readily connected to or disconnected from the externally threaded outlet end of a water faucet F. Water under pressure in faucet F flows against the upper surface of a circular flow controller 2 and through an opening 3 which is concentric to the central vertical axis A of the aerator.

The independent jet thus formed is directed downwardly into a diffusing chamber 4 within a circular diffuser element 5. The latter has a raised floor 5*a* surrounded by an annular trough 6 and also has at its upper portion an annular outwardly-extending flange 5*b*, the floor forming a recessed seat for controller 2. The annular side wall of diffuser 5 is provided with a series of vertical slots 5*c* spaced evenly around the diffuser and extending from the upper portion of the side wall to the bottom level of trough 6.

Water from diffusing chamber 4 passes radially outward through slots 5*c*, further diffusing the water, and thence into an annular passage 7 formed between the side wall of diffuser 5 and surrounding ring 8. The jets of water from slots 5*c* are still further diffused in passage 7 and then discharged downwardly into a mixing chamber 10. The bottom of ring 8 is provided with a sharp annular edge 8*a* which acts upon the jets of discharging water to diffuse them further into a fine spray and direct them back toward the center of the mixing chamber.

Mixing chamber 10 is located within a basket 11 having a central bottom opening surrounded by an inwardly extending annular flange 11*a*. The latter supports a pair of fine screens 12. At its upper portion, basket 11 has an outwardly extending annular flange 11*b* resting upon an internal annular seat 1*b* of the barrel 1. The side wall of basket 11 is spaced from the surrounding wall of barrel 1 so as to form an annular passage 14 open at the bottom and closed at the top by flange 11*b*. Passage 14 communicates with the upper part of mixing chamber 10 through horizontally-extending slots spaced around the side wall of basket 11, one of these slots being shown at 15.

As will be readily apparent to those skilled in the art, the jet action of the fine spray descending from the annular inner passage 7 creates a negative static pressure in mixing chamber 10. As a result, atmospheric air is sucked up through the outer annular passage 14 and enters chamber 10 through the basket slots 15. The water and air mixed in chamber 10 are discharged downwardly through the fine screens 12, which retard the flow somewhat and further contribute to the mixing to produce an aerated, soft, bubbly stream of liquid issuing from the aerator.

Figure 2:
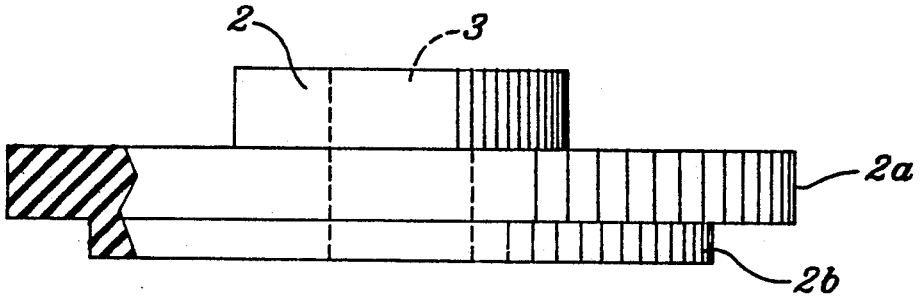
FIG. 2 is a side elevation, partly in section, of the flow conroller plug.

Attention is now directed to the flow controller plug 2. It is preferably formed of rubber and comprises (FIG. 2) an upper section 2*a* which extends outward to above the flange 11*b* (FIG. 1), and a lower section of reduced diameter 2*b*.

Figure 3:
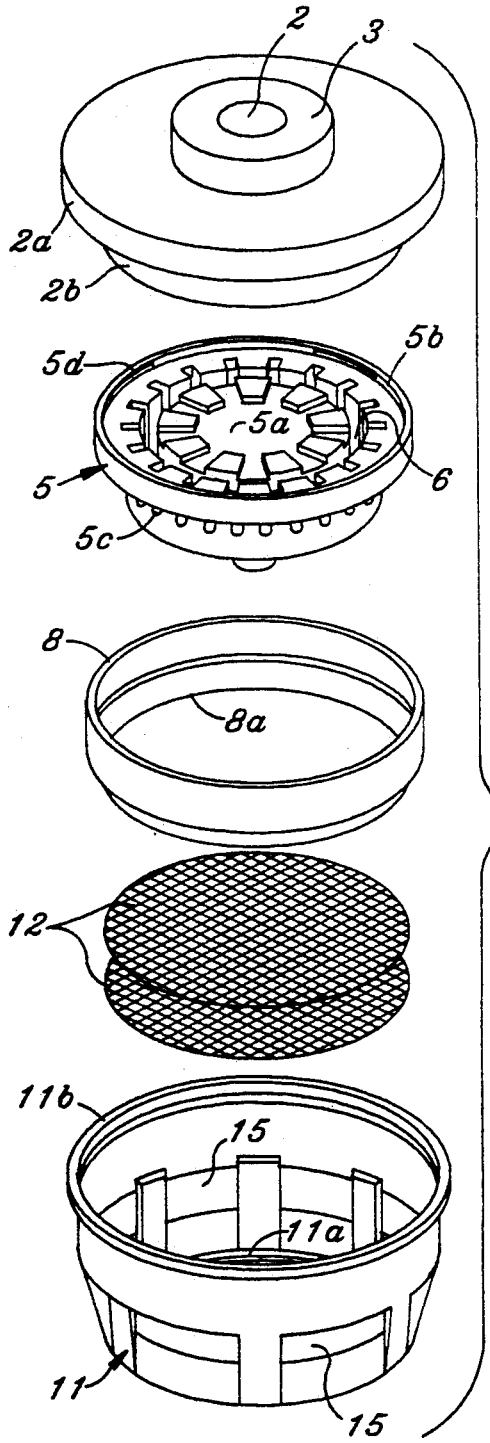
FIG. 3 is an exploded view of the internal parts of the aerator.
Figure 4:
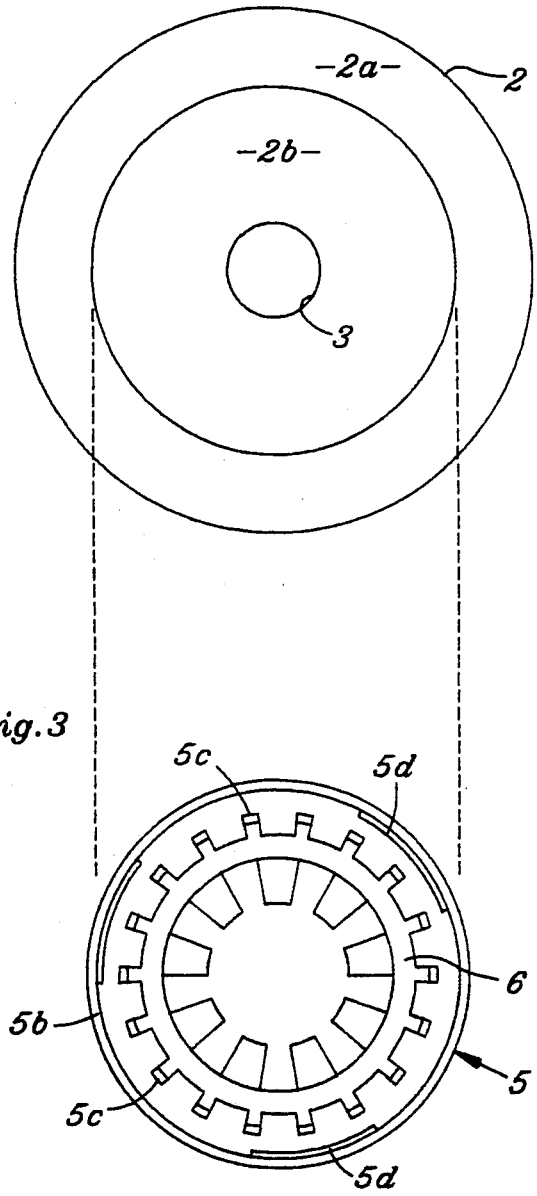
FIG. 4 is a bottom plan view of the flow controller plug superposing a top plan view of the diffuser.

The annular flange 5*b* of diffuser 5 has an upwardly extending portion surrounding the lower section 2*a* of the flow controller plug 2 and also has three detents 5*d* (FIG. 3) equally spaced around the top of the flange to define a socket.

The opening 3 is surrounded by the hub 2*a* which as is known in the art contracts in dimension under higher water pressures to close down the opening 3, reducing flow.

When, in assembly, the plug is pressed against the top of the diffuser, section 2*b* of the plug will squeeze into the flange 5*b*, with its detents 5*d* to comprise a unit. It should be understood that the ring 8 and basket 11 are already functionally held on the diffuser.

The arrangement described accomplishes desirable objectives. First, with the parts pressed together as described, they comprise an easy-to-handle, store and transport pre-assembly. This makes possible a relatively easy final assembly into the barrel. Further, the margin of the wider upper section of the plug is in a position to make unnecessary the additional washer of the prior art as set forth in the above-mentioned patent. While the structure described in that patent is meritorious in every way, it does require an extra sealing washer.

Variations in the invention are possible without departing from the spirit of the invention. Thus, while the invention has been shown in only one embodiment, it is not so limited but is of a scope defined by the following claim language which may be broadened by an extension of the right to exclude others from making or using the invention as is appropriate under the doctrine of equivalents.

What is claimed is:

1. In a water aerator for delivering an aerated bubbly stream, the combination of a cylindrical barrel adapted to be removably secured at its upper portion to a source of water under pressure, a basket mounted in the barrel and surrounding a mixing chamber, screen means supported by the basket below said chamber and through which said stream is adapted to be discharged, said barrel and basket having opposing parts forming a passage for flow of atmospheric air into the mixing chamber due to a reduced pressure therein, a diffuser overlying the mixing chamber and forming a diffuser chamber positioned to receive water from said source, the diffuser chamber being open at the top and having peripheral openings for diffusing a flow of water outwardly from the diffuser chamber to the mixing chamber, the diffuser also having at its upper end a seat surrounded by an upward flange, and a resilient flow restrictor plug supported on said diffuser and having a control opening for admitting water from said source to the diffuser chamber, the opening being defined by an enlarged upwardly directed hub contracting inwardly under increased pressure to reduce the diameter of the control opening, said control opening, diffuser chamber, peripheral openings and mixing chamber forming a path through which water is adapted to flow from said source to said screen means for discharge from the aerator, the improvement wherein the flow restrictor plug comprises a wider upper section extending out over the top of the basket, and a lower narrower section defining a head which frictionally squeezes into the upward flange defining a socket on the diffuser to hold the flow-restrictor plug in assembly with the diffuser.

2. A water aerator as claimed in claim 1 wherein the inner surface of the upper flange on the diffuser is formed with inward detents to hold better the plug in assembly.

* * * * *